US006543774B1

(12) United States Patent
Taylor

(10) Patent No.: US 6,543,774 B1
(45) Date of Patent: Apr. 8, 2003

(54) CARD GAME WITH LIVES REMAINING AND SCORE BASED ON BID ACCURACY

(76) Inventor: Lloyd Taylor, P.O. Box 213, Esparto, CA (US) 95627

( * ) Notice: Subject to any disclaimer, the term of this patent is extended or adjusted under 35 U.S.C. 154(b) by 100 days.

(21) Appl. No.: 09/929,482

(22) Filed: Aug. 13, 2001

(51) Int. Cl.[7] ..... A63F 9/20
(52) U.S. Cl. ..... 273/292
(58) Field of Search ..... 273/292, 303, 273/274, 309

(56) References Cited

U.S. PATENT DOCUMENTS

| | | | | | |
|---|---|---|---|---|---|
| 4,009,884 | A | * | 3/1977 | Weigl | 273/296 |
| 4,248,434 | A | * | 2/1981 | Weigl | 273/296 |
| 4,900,027 | A | * | 2/1990 | Sheridan | 700/92 |
| 4,961,581 | A | * | 10/1990 | Barnes et al. | 273/236 |
| 5,213,334 | A | * | 5/1993 | Yih | 273/292 |
| 5,549,301 | A | * | 8/1996 | Gerrard | 273/305 |
| 5,944,314 | A | | 8/1999 | Stavinsky | |
| 5,954,334 | A | | 9/1999 | Parker, Jr. | |
| 6,003,870 | A | | 12/1999 | Johnson | |
| 6,059,291 | A | * | 5/2000 | Gary | 273/300 |
| 6,155,567 | A | | 12/2000 | Keleher | |
| 6,220,597 | B1 | | 4/2001 | Scibetta | |
| RE37,957 | | * | 1/2003 | Garfield | 273/308 |

FOREIGN PATENT DOCUMENTS

WO WO 93/05855 4/1993

OTHER PUBLICATIONS

McLeod, John: Toepen, http://www.pagat.com/last/toepen.html.*

McLeod, John: Spades, http://www.pagat.com/boston/spades.html.*

Morehead et al.: The New Complete Hoyle Revisd, 1991, Doubleday, p. 129–159.*

* cited by examiner

*Primary Examiner*—Michael O'Neill
*Assistant Examiner*—Christina Marks
(74) *Attorney, Agent, or Firm*—Charles L. Thoeming

(57) ABSTRACT

A gaming method using a 52 cards presenting a plurality of suits and a plurality of card values, including the steps of dealing to four players an equal number of cards until all cards has been distributed, designating a constant trump suit, bidding tentative trick quotas within a defined bidding hierarchy playing a plurality of tricks until all distributed cards have been played, assigning values associated with the degree of bidding accuracy based upon the tricks actually taken, continuing play until all players establish a finish position so that exact finishes can be awarded, and providing ranking points to each player depending upon the player's respective finish in the game. A player is also allocated nine lives where one life is deducted for each trick that is overbid or underbid. Any player losing all nine lives before the game is ended for feits their seat in the game.

11 Claims, 2 Drawing Sheets

SCORING

ONCE ALL 13 CARDS HAVE BEEN PLAYED, YOU ARE THEN AWARDED POINTS FOR THE ACCURACY OF YOUR BID. HERE ARE THE EIGHT DIFFERENT WAYS 4 PLAYERS CAN FINISH 1ST, 2ND,3RD, 4TH, AND ALL VARIATIONS OF TIES.

PLAYER 1ST PLACE = 12
PLAYER 2ND PLACE = 10
PLAYER 3RD PLACE = 8
PLAYER 4TH PLACE = 6

THIS IS THE ONLY RACE WITHOUT TIES. THE REMAINING 7 ALL INVOLVE TIES. 36 POINTS ARE AWARDED EACH BIDDING ROUND.

---

PLAYER 1ST PLTIE = 9
PLAYER 1ST PLTIE = 9
PLAYER 1ST PLTIE = 9
PLAYER 1ST PLTIE = 9

PLAYER 1ST PLTIE = 10
PLAYER 1ST PLTIE = 10
PLAYER 1ST PLTIE = 10
PLAYER 4TH PLACE = 6

---

PLAYER 1ST PLTIE = 11
PLAYER 1ST PLTIE = 11
PLAYER 3RD PLTIE = 7
PLAYER 3RD PLTIE = 7

PLAYER 1ST PLTIE = 11
PLAYER 1ST PLTIE = 11
PLAYER 3RD PLACE = 8
PLAYER 4TH PLACE = 6

---

PLAYER 1ST PLACE = 12
PLAYER 2ND PLTIE = 8
PLAYER 2ND PLTIE = 8
PLAYER 2ND PLTIE = 8

PLAYER 1ST PLACE = 12
PLAYER 2ND PLTIE = 9
PLAYER 2ND PLTIE = 9
PLAYER 4TH PLACE = 6

---

PLAYER 1ST PLACE = 12
PLAYER 2ND PLACE = 10

PLAYER 3RD PLTIE = 7
PLAYER 3RD PLTIE = 7

---

SCORING

ONCE ALL 13 CARDS HAVE BEEN PLAYED, YOU ARE THEN AWARDED POINTS FOR THE ACCURACY OF YOUR BID. HERE ARE THE EIGHT DIFFERENT WAYS 4 PLAYERS CAN FINISH 1ST, 2ND,3RD, 4TH, AND ALL VARIATIONS OF TIES.

PLAYER 1ST PLACE = 12
PLAYER 2ND PLACE = 10
PLAYER 3RD PLACE = 8
PLAYER 4TH PLACE = 6

THIS IS THE ONLY RACE WITHOUT TIES. THE REMAINING 7 ALL INVOLVE TIES. 36 POINTS ARE AWARDED EACH BIDDING ROUND.

---

| | |
|---|---|
| PLAYER 1ST PL.TIE = 9 | PLAYER 1ST PL.TIE = 10 |
| PLAYER 1ST PL.TIE = 9 | PLAYER 1ST PL.TIE = 10 |
| PLAYER 1ST PL.TIE = 9 | PLAYER 1ST PL.TIE = 10 |
| PLAYER 1ST PL.TIE = 9 | PLAYER 4TH PLACE = 6 |

---

| | |
|---|---|
| PLAYER 1ST PL.TIE = 11 | PLAYER 1ST PL.TIE = 11 |
| PLAYER 1ST PL.TIE = 11 | PLAYER 1ST PL.TIE = 11 |
| PLAYER 3RD PL.TIE = 7 | PLAYER 3RD PLACE = 8 |
| PLAYER 3RD PL.TIE = 7 | PLAYER 4TH PLACE = 6 |

---

| | |
|---|---|
| PLAYER 1ST PLACE = 12 | PLAYER 1ST PLACE = 12 |
| PLAYER 2ND PL.TIE = 8 | PLAYER 2ND PL.TIE = 9 |
| PLAYER 2ND PL.TIE = 8 | PLAYER 2ND PL.TIE = 9 |
| PLAYER 2ND PL.TIE = 8 | PLAYER 4TH PLACE = 6 |

---

| | |
|---|---|
| PLAYER 1ST PLACE = 12 | PLAYER 3RD PL.TIE = 7 |
| PLAYER 2ND PLACE = 10 | PLAYER 3RD PL.TIE = 7 |

---

FIG. 1

NAME:----------) <><><>NAME:----------)

#-BID-MADE-PL-ACC-INACC-H-<>-BID-MADE-PL-ACC-INACC-H 1.( )--( )-( )-( / )-( = )( ) <> ( )--( )-( )-( / )( = )( )

2.( )--( )-( )-( / )-( = )( ) <> ( )--( )-( )-( / )( = )( )

3.( )--( )-( )-( / )-( = )( ) <> ( )--( )-( )-( / )( = )( )

4.( )--( )-( )-( / )-( = )( ) <> ( )--( )-( )-( / )( = )( )

5.( )--( )-( )-( / )-( = )( ) <> ( )--( )-( )-( / )( = )( )

6.( )--( )-( )-( / )-( = )( ) <> ( )--( )-( )-( / )( = )( )

7,( )--( )-( )-( / )-( = )( ) <> ( )--( )-( )-( / )( = )( )

8.( )--( )-( )-( / )-( = )( ) <> ( )--( )-( )-( / )( = )( )

9.( )--( )-( )-( / )-( = )( ) <> ( )--( )-( )-( / )( = )( )

10( )- ( )-( )-( / )-( = )( ) <> ( )--( )-( )-( / )( = )( )

11( )- ( )-( )-( / )-( = )( ) <> ( )--( )-( )-( / )( = )( )

NAME: ----------) NAME:----------)

#-BID-MADE-PL-ACC-INACC-H-<>-BID-MADE-PL-ACC-INACC-H 1.( )--( )-( )-( / )-( = )( ) <> ( )--( )-( )-( / )( = )( )

2.( )--( )-( )-( / )-( = )( ) <> ( )--( )-( )-( / )( = )( )

3.( )--( )-( )-( / )-( = )( ) <> ( )--( )-( )-( / )( = )( )

4.( )--( )-( )-( / )-( = )( ) <> ( )--( )-( )-( / )( = )( )

5.( )--( )-( )-( / )-( = )( ) <> ( )--( )-( )-( / )( = )( )

6.( )--( )-( )-( / )-( = )( ) <> ( )--( )-( )-( / )( = )( )

7.( )--( )-( )-( / )-( = )( ) <> ( )--( )-( )-( / )( = )( )

8.( )--( )-( )-( / )-( = )( ) <> ( )--( )-( )-( / )( = )( )

9.( )--( )-( )-( / )-( = )( ) <> ( )--( )-( )-( / )( = )( )

10( )- ( )-( )-( / )-( = )( ) <> ( )--( )-( )-( / )( = )( )

11( )- ( )-( )-( / )-( = )( ) <> ( )--( )-( )-( / )( = )( )

FIG. 2

CARD GAME WITH LIVES REMAINING AND SCORE BASED ON BID ACCURACY

CROSS-REFERENCES TO RELATED APPLICATIONS

None.

STATEMENT REGARDING FEDERALLY SPONSORED RESEARCH OR DEVELOPMENT

None.

REFERENCE TO A MICRO-FICHE APPENDIX

None.

BACKGROUND OF THE INVENTION

1. Field of the Invention

Various card games, such as Bridge or Spades, use bidding and trump suits for two partner play with a standard four suit, fifty-two card deck. These games mostly reward the luck of being dealt high cards and accordingly being able to place the highest bid. Bridge, Spades, and similar games also require partnerships with players of equal or superior skill in order to be effective in tournament or competitive level play. In addition, on-line or electronic gaming room versions of Bridge, Spades, or the like are vulnerable to players who use "straw" partners or otherwise manipulate the scoring mechanisms to adversely effect the play of honest participants. The on-line games are also vulnerable to players who are not capable or who quit in the middle of a game, thus ending the game for the other players without a significant result.

The present card game method improves these gaming deficiencies by minimizing the luck factor of cards dealt, maximizing the reward for skillful bidding, and elimination of partnership play. All players compete against each other. One suit is always trump. Bidding accuracy is encouraged by a scoring system which insures that the most accurate bidder will always win the game.

2. Description of the Related Art Including Information Disclosed under 37 C.F.R. 1.97 and 1.98

A search of the prior art located the following United States patents which are believed to be representative of the present state of the prior art: U.S. Pat. No. 6,220,597 B1, issued Apr. 24, 2001, U.S. Pat. No. 6,155,567, issued Dec. 5, 2000, U.S. Pat. No. 6,003,870, issued Dec. 21, 1999, U.S. Pat. No. 5,954,334, issued Sep. 21, 1999, U.S. Pat. No. 5,944,314, issued Aug. 31, 1999, U.S. Pat. No. 5,375,845, issued Dec. 27, 1994, International Publication No. WO 93/05855, published Apr. 1, 1993.

In the area of rewarding skill and accuracy in bidding, the present invention card game method departs substantially from the conventional concepts and designs of the prior art. Accordingly, a card game primarily developed for the purpose of rewarding accuracy in bidding and play is presented by the present invention card game method.

BRIEF SUMMARY OF THE INVENTION

The present card game method rewards skill in bidding, and the skill of making that bid. High cards count, but only to obtain the tricks bid. After the bid is made, low cards are strategically used to avoid exceeding the bid. A card game of bidding skill is presented, principally with four independent players.

There is a need to improve the present on-line tournament play for card games. On-line card tournaments are floundering. On-line card play is driven by the luck of cards dealt equaling player ability. In games 6–12 hands long, players getting the high cards dealt to them win more games, regardless of the skill factor of the players. This aspect on current on-line card games frustrates elite players. Present on-line tournaments for Bridge, Spades and similar games require a partner. The skill level of one's partner is critical. The present card game invention eliminates partner play, and with the emphasis on bidding skill, player participation in on-line tournaments for the present invention should be enthusiastic.

The present invention achieves the advantages over the prior art by comprising a card game and method of playing the game which is similar to Spades in the sense of following suit and the use of trump cards, but entirely different in the rules and procedures. Principally designed for four individual players, a regular deck of 52 cards is used. Initially, each player is dealt thirteen cards. The present invention rewards accurate bidding and accurate play to achieve the exact bid.

The foregoing broadly outlines the more important features of the invention in order that the detailed description thereof that follows may be better understood, and so that the present invention may be better appreciated. Additional features of the present invention will be described hereinafter and will form the subject matter of the claims appended hereto.

In this respect, before explaining at least one embodiment of the invention in detail, it is to be understood that the present invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of describing and should not be regarded as limiting.

Thus, those skilled in the art will appreciate that the conception, upon which this disclosure is based, may readily be utilized as a basis for the designing of other games, structures, methods and/or systems for carrying out the several purposes of the present invention. Therefore, it is important that the claims be regarded as including such equivalent construction insofar as they do not depart from the scope and spirit of the present invention.

Additionally, the purpose of the foregoing abstract is to enable the United States Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the application, which is measured by the claims, nor is it intended to be limiting as to the scope of the invention in any way.

It is therefore an object of the present invention to provide a new and improved card game which has many of the advantages of the prior art games and presents new challenges.

It is another object of the present invention to provide a new and improved card game which may be easily learned and played.

It is yet another object of the present invention to provide a new and improved card game which may be easily and efficiently adapted to on-line and electronic card room play.

It is still another object of the present invention to provide a new and improved card game which rewards bidding accuracy.

Yet another object of the present invention to provide a new and improved card game which neutralizes the luck factor of cards dealt during play.

Even still another object of the present invention to provide a new and improved card game which maximizes individual ability as opposed to partner play.

Another object of the present invention to provide a new and improved card game which minimizes the effect of a player's lack of ability on play for the other players.

Yet another object of the present invention to provide a new and improved card game which eliminates loss of play for the remaining players as a result of an on-line player quitting before a game is decided.

Other features, advantages, and objects of the present invention will become apparent with reference to the following description and accompanying drawings.

BRIEF DESCRIPTION OF DRAWINGS

FIG. 1 is all possible tied scoring variations and the resulting scoring awards.

FIG. 2 is a representative scoring talley sheet for face-to-face play among four players in person.

DETAILED DESCRIPTION OF THE INVENTION

The present invention uses a standard 52 card deck array comprising thirteen cards in four suits, spades, hearts, diamonds and clubs, and further comprising within each suit an array from the lowest, deuce or 2, to the highest, ace. The preferred embodiment of the present invention card game is played by four players. The 52 card deck is dealt face down one card at a time by one player sequentially in a clockwise direction to all four players until the entire deck has been dealt resulting in each player holding thirteen cards. Dealing is shared among the four players and passed in a clockwise direction to the next dealer after each hand. All players are competing against each other. Spades are always trump. The other three suits have equal value, but below the trump suit of spades. Thus, any spade card has a higher value than any card of the other three suits. Although the present card game invention can be played by four individuals sitting together at a table for face-to-face play, its preferred embodiment is as an on-line game among four participating players within computer controlled game-rooms.

The goal of the present card game invention is to make your bid contract. Making the bid contract requires a player to win the number of tricks bid by the player on the particular hand. Tricks are won by the highest card played in either the trump suit or the suit led. The present card game invention allows a "halo" rule wherein a deuce which is played immediately after the ace of the same suit becomes higher in value than the ace, and in this instance takes the trick.

In live, face-to-face play, the players cut the deck of cards and the player cutting the high card is the initial dealer. For on-line computer generated play, the player with the highest player rating points among the game players is the initial dealer.

Once all cards have been dealt, a single round of bidding begins, starting with the first player to have been dealt a card and continuing clockwise around the table until the player who dealt the cards ends the bidding round by placing a bid. A trick is a set of four played cards, one card from each player. Since each player is dealt thirteen cards, the face value for the total number of tricks per hand is thirteen. However, in the method of the present invention the last trick of the hand is worth double. Thus, the total number of tricks per hand is fourteen. The last bid by the dealer can be for any number of tricks except one that totals fourteen for all four players. For example, if the first player bids three tricks, and the second player bids four tricks, and the third player bids two tricks, the dealer would be limited to bidding anywhere from zero to fourteen tricks, but not five tricks since the total of all bids would equal fourteen. An exception to the limits placed on the last bid by the dealer is if any prior player bids fourteen tricks, the dealer can bid any number of tricks. Additionally, if the first three players all bid zero tricks, the last player can bid fourteen tricks.

After the bidding, the first player to open the bidding opens play by leading a card from one of the three minor suits, hearts, diamonds or clubs. The suit led by the first player becomes the suit for that particular round of play which follows clockwise by each player following suit. If a player does not hold any cards in the suit led, the player must play a spade trump. Only if a player is void in trump and the suit led, can a non-trump card or a card from a suit other than the suit led be played. Since spades are always trump, the highest spade wins the trick, subject to the "halo" rule. If no trump cards are played, the trick is taken by the player who plays the highest card of the suit led. The lead continues from the player taking the previous trick. Players who lead may play any card with the exception of trump. No player may lead with a spade until a spade has been discarded in a previous round of play or unless spades is the only suit left in the lead player's hand. Play continues in this fashion until all thirteen cards have been played.

Once all thirteen cards have been played, each player is awarded points for the accuracy of their respective bid. First place in bid accuracy is awarded twelve points. Second place in bid accuracy is awarded ten points. Third place in bid accuracy is awarded eight points. Fourth place in bid accuracy is awarded six points. Thus, 36 points are awarded for each bidding round. In the case of ties at a particular placement in bid accuracy, the points for each place are added and the points shared evenly between or among the tied players. All possible tied scoring variations and the resulting scoring awards are presented in FIG. 1.

At the beginning of each game, each player has nine lives. On each dealt and bid hand, lives are lost by players who inaccurately bid the hand. One life is lost for each over or under trick by which the player misses their bid. Game play continues until at least three players reach 100 points or more with at least one life remaining or at least three players lose all nine lives, or any combination of both. Any player losing all nine lives before the game is finished forfeits their seat at the game, is awarded the lowest available finish in the game, exits the game, and is replaced by the system computer for on-line play. For live, face-to-face play, those players that exit the game and receive a finish in the game re-enter the game to keep, it four-handed. The players now play by the exact rules of computer play, and continue in the game until at least three (3) players reach 100 points or more with at least one life remaining, or at least three (3) players lose all 9 lives, or any combination of both. In this fashion, all finishes for the game are known exactly.

For face-to-face play various circumstances may result in declaration of a misdeal. If the dealer or a player turns a card or cards belonging to another player face up prior to the completion of the deal, a misdeal is declared and the same dealer deals again. If the dealer or player turns a card or cards belonging to themselves face up prior to the completion of the deal, the deal stands. If a card is found face up in the deck during the deal, a misdeal is declared and the same dealer deals again. If one or more players have too few or too many cards and this circumstance is discovered prior to completion of the first trick, a misdeal is declared and the same dealer deals again. If one or more players have too few or too many cards and this circumstance is discovered after completion of the first trick, those players will lose one life from their score, a misdeal is declared and the same dealer deals again. Any lead or play out of turn must be retracted if demand is made by a player before all have played to the trick; however, if all have played, the play out of turn stands as a regular turn of play without penalty.

Failure to follow suit when able constitutes a renege. A renege may be corrected before the trick is picked up from the table and turned face down. If it is not discovered until later and the renege is established, play immediately ceases, and the reneging player must pay a penalty of a loss of two lives subtracted from their score. All remaining players' bids are now void, cards are reshuffled and the same dealer deals another hand.

First place in the game is awarded to the first player to reach 100 points or more with at least one life remaining. In on-line play, the first place winner is replaced by the system computer, with the remaining players vying for second, third, and fourth place finishes. The first player to lose all nine lives before the end of the game automatically receives fourth place. The game continues with a computer player taking over for the fourth place player in the preferred embodiment of the present card game invention. Scoring is kept by a tally system which records each player's name, their hand number, their bids, their tricks taken, their place, their accuracy points, their bid inaccuracy or lives (difference between bid and tricks taken), and their "halo" tricks, as shown in FIG. 2. "Halo" tricks are used to for tie-breakers in instances when players exit games with zero lives.

In the event that two or more players exit on the same hand with zero lives or less, the player with the most lives wins the higher place in the game relative to those other players exiting with that player. If there is a tie in the number of lives, the player with the most halos then is awarded the higher place in the game relative to those other players exiting with that player with the same number of lives. If players are tied with lives and halos, the next tie-breaker awards the higher place to the player with the most total points relative to those other players exiting with that player with the same number of lives and halos. The third tie-breaker becomes the player with the most first place finishes relative to those other players exiting with that player. A fourth tie-breaker, if necessary, becomes the player with the most first and second place finishes relative to those other players exiting with that player with the same number of lives.

In the event that two or more players reach 100 points or more with at least one life remaining, first place is awarded to the player with the most points. If two or more players tie with points in reaching 100 points or more with at least one life remaining, the first level of tie breaker is to award first place to the player with the most lives remaining. If there is a tie at that level, the next tie-breaker is the most first place finishes. The third tie-breaker becomes the most first and second place finishes. A fourth tie-breaker, if necessary, becomes the most first, second and third place finishes. The fifth tie-breaker is most first place points. In the unlikely event that a sixth tie-breaker is necessary, it would be the most first and second place points. In this manner, bidding skill based upon the accuracy of a player's ability to evaluate and make each hand's bid, not luck based principally on cards dealt, is rewarded.

In the preferred embodiment of on-line play of the present card game invention, the computer player is inserted into the game to keep the game among four players and allow for exact finishes for the remaining players. Computer players will replace any players who: (i) receive a first, second, third, or fourth place finish, known as positioned players; (ii) quit; or (iii) disconnects or delays a game when other players vote to continue. The computer player bids the number of trump (spades) in hand. If possible, the computer player will always play the highest card in its hand following the suit lead per round under the standard rules. If a card higher than the highest suit card played to that point is not available, the computer player will play the lowest card of the corresponding suit. If the computer player is void in the suit led and it is the first player to play trump, it plays the lowest trump card in its hand. If the computer player is void in the suit led and it is not the first player to play trump and it can play higher than trump played, it plays the highest trump card in its hand. If the computer player is void in the suit led and it is not the first player to play trump and it can not play higher than trump played, it plays the lowest trump card in its hand. If the computer player is void in the suit led and it is void in trump, the computer player plays its highest card of the two remaining suits. When the computer player has the lead, it plays its highest non-trump card, and continues until overtaken. When the computer player has the lead and it only holds trump cards, it plays the highest trump card it holds, and continues until overtaken. The computer player(s) scoring is the same as other players, but only to serve to keep the accuracy of the game in place. Computer players do not receive a finish in the game; they function, instead, to give players their exact finish in the game.

In live face-to-face play, positioned players follow the same play rules as the computer player for positioned players until all finishes are known exactly for each player.

For the preferred embodiment of the present invention, players entering rated gaming rooms shall have a rating. Players are initially assigned a rating of 2500 points upon entry into rated gaming rooms. Rating points are increased with a first or a second place finish in a rating room game. Third and fourth place finishes in a rating room game decrease rating points. All four players beginning a rating room game each contribute one percent (1%) of their respective rating points into a rating room game pool. A player's respective rating point total is decreased by the amount of the player's contribution to a rating room game pool. Each place in the rating room game will award a percentage of that rating room game point pool total as follows: first place is awarded forty-five percent (45%) of the rating room game point pool; second place is awarded thirty percent (30%) of the rating room game point pool; third place is awarded fifteen percent (15%) of the rating room game point pool; and fourth place is awarded ten percent (10%) of the rating room game point pool. At the end of rated gaming room games, each player's rating points are adjusted according to the player's finish in the game, and the overall gaming room rankings are adjusted accordingly.

On-line players can access all four players' tally sheet information at anytime by clicking the score function on the computer monitor used by the players.

Other embodiments of the present card game invention could include partner play, varying number of lives, and alternative trump suits. Additionally, since the present card game invention presents defined bid accuracy use and hierarchy within a defined four by thirteen data array, it can be extended to any game of opposites. Bidding can represent decisions based upon limited knowledge of the entire array. Hand play can represent progress along any defined journey, where the journey becomes increasingly more difficult with inaccuracy and less difficult with accuracy. The ultimate goal is for the player who remains in the game the longest before elimination to establish a record based upon that player's continued accuracy. Thus, the method of the present invention can be extended into any game of opposites such as good versus evil, knowledge versus ignorance, strength versus weakness, light versus darkness, and so on.

The principles of the present card game invention have been clearly presented in the preceding illustrative and explanatory text; however, those skilled in the art may make any modifications in the modes of play and array configurations of the invention without departing from those principles. It is intended, therefore, that the description and drawings be considered and interpreted as illustrative and not merely limiting, and that the present card game invention be given a scope commensurate with the appended claims.

I claim:

1. A method of playing a card game with a plurality of players comprising the steps of:

a) providing a deck of tangible or computer generated cards further comprising a four by thirteen array wherein four different suits are arranged in ascending order by numerical indicia wherein each suit has thirteen cards corresponding in value from 1 to 13 respectively;

b) selecting an initial dealer from the highest card cut from the deck of cards in live, face-to-face play, or from the player with the highest player rating points among the on-line players of the game;

c) randomly shuffling the deck so as to mix the array of cards;

d) designating at most one suit as trump;

e) awarding each player nine lives;

f) beginning a round of play by dealing a first hand of 13 cards to each player from the shuffled array;

g) applying means for determining whether a misdeal has occurred;

h) each player bidding on a number of tricks they believe will be taken with their hand, beginning with the player to the left of the dealer and continuing in a clockwise direction until the dealer has placed their bid;

i) assigning a trick as a set of four cards played, one from each player;

j) assigning a value of one point per each trick taken up to the last trick;

k) assigning a two point value to the last trick taken, l) limiting the dealer's bid to be a bid which when added to the three previous bids would not total 14, unless any prior player bids 14 tricks or all three prior players bid zero tricks, in which case the dealer can bid any number of tricks;

m) opening play by the first player to bid, by playing a card from any suit other than trump, unless trump is the only suit in the player's hand, wherein play continues in clockwise sequence wherein each successive player must play a card following the suit led and wherein the trick is taken by the player playing the highest card value of the respective suit, unless in the sequence of play the lowest valued card is played immediately after the highest valued card in the suit, wherein the lowest valued card takes the trick under a "halo" rule, or unless the player does not have any remaining cards in the suit led, in which they must play a trump suit card, wherein the trick is taken by the player playing the highest value trump suit card, or unless the player does not have trump or cards in the suit led, in which they may play any card of the other two suits;

n) repeating steps e) through k) until each player has played all the cards in their hand and all the tricks have been taken, wherein no player may lead with trump unless trump has been discarded in a previous round of play or unless trump is all that remain in the lead player's hand;

o) awarding each player points based upon the accuracy of their bid from a point total of thirty-six, wherein first place is awarded twelve points, second place is awarded ten points, third place is awarded eight points, and fourth place is awarded six points, and wherein the case of tied bidding accuracy, the points for each place are added and are shared equally between or among the tied players;

p) deducting lives from each player's nine lives based upon one life lost for each over trick or under trick from the number of tricks bid by the player;

q) awarding the lowest finish remaining to any player losing all nine lives, wherein in case of tied losses of lives, employing a predetermined means for lowest finish tie breaking;

r) totaling the point totals for each player; and s) repeating steps f) through q) until all players have established finish positions in the game wherein the first player to reach 100 points with at least one life remaining is awarded the first place finish, wherein in case of tied point totals, employing predetermined means for tie breaking.

2. The method of claim 1 wherein the means for determining whether a misdeal has occurred for face-to-face play further comprises the steps of:

a) declaring a misdeal and requiring the dealer to re-deal if the dealer or a player turns a card or cards belonging to another player face up prior to the completion of the deal;

b) declaring the deal to be valid, if the dealer or player turns a card or cards belonging to themselves face up prior to the completion of the deal;

c) declaring a misdeal and requiring the dealer to re-deal if a card is found face up in the deck during the deal;

d) declaring a misdeal and requiring the dealer to re-deal if one or more players have too few or too many cards and this circumstance is discovered prior to completion of the first trick;

e) declaring a misdeal, requiring the dealer to re-deal, and deducting one life from each offending player(s)' score if one or more players have too few or too many cards and this circumstance is discovered after completion of the first trick;

f) retracting any lead or play out of turn if demand is made by a player before all have played to the trick;

g) letting play stand without penalty for any lead or play out of turn if all have played;

h) declaring a renege for any player's failure to follow suit when able by correcting before the trick is picked up from the table and turned face down, or ceasing play immediately if the renege is established later and (i) subtracting two lives from the reneging player's score, (ii) voiding all remaining players' bids, (iii) reshuffling the deck, and (iv) re-dealing another hand by the same dealer.

3. The method of claim 2 wherein the means for lowest place finish tie breaking further comprises the steps:

a) awarding the player with the most lives the higher place finish in the game relative to those other players exiting with that player on the same hand;

b) awarding the player with the most halos the higher place finish in the game relative to those other players exiting with that player on the same hand with the same number of lives;

c) awarding the player with the most total points the higher place finish in the game relative to those other players exiting with that player on the same hand with the same number of lives and halos, if necessary;

d) awarding the player with the most first place finishes in rounds of play the higher place finish in the game relative to those other players exiting with that player with the same number of lives, halos, and total points, if necessary; and e) awarding the player with the most first place and second place finishes in rounds of play the higher place finish in the game relative to those other players exiting with that player with the same number of lives, halos, points, and first place finishes, if necessary.

4. The method of claim 3 wherein the means for first place tie breaking further comprises the steps:

a) awarding the player with the most points first place as a first level tie breaker with players who reach 100 points or more with at least one life remaining on the same hand;

b) awarding the player with the most lives remaining as a tie breaker with players who reach 100 points or more with at least one life remaining on the same hand with the same number of points;

c) awarding the player with the most first place finishes in rounds of play first place as a tie breaker with players who reach 100 points or more with at least one life remaining on the same hand with the same number of points and lives remaining, if necessary;

d) awarding the player with the most first place and second place finishes in rounds of play first place as a tie breaker with players who reach 100 points or more on the same hand with the same number of points, lives remaining, and first place finishes, if necessary;

e) awarding the player with the most first place, second place, and third place finishes in rounds of play first place as a tie breaker with players who reach 100 points or more on the same hand with the same number of points, lives remaining, first place finishes, and second place finishes, if necessary; and f) awarding the player with the most first place points in rounds of play first place as a tie breaker with players who reach 100 points or more on the same hand with the same number of points, lives remaining, first place finishes, second place finishes, and third place finishes, if necessary.

5. The method of claim 4, wherein the thirteen cards in each suit are the deuce, three, four, five, six, seven, eight, nine, ten, jack, queen, king, and ace, and wherein the deuce is designated as the lowest valued card in the suit with increasing card values for each successive numbered card in this sequence leading to the ace as the highest card in the suit.

6. The method of claim 5, wherein the suits are spades, hearts, diamonds, and clubs.

7. The method of claim 6, wherein the number of players equals four.

8. The method of claim 7, wherein each player achieving a finish status becomes a positioned player within the game, wherein the gaming method for each positioned player further comprises the steps of;

a) bidding the number of trump in hand;

b) playing if possible, the highest card in its hand;

c) following the suit lead per round under the standard rules unless a card higher than the highest suit card played to that point is not available, at which point playing the lowest card of the corresponding suit;

d) playing the lowest trump card in it hand when it is void in the suit led and it is the first player to play trump;

e) playing the highest trump card in its hand when it is void in the suit led and it is not the first player to play trump and it can play higher than trump played;

f) playing the lowest trump card in its hand when it is void in the suit led and it is not the first player to play trump and it can not play higher than trump played;

g) playing the highest non-trump and non-suit card in its hand when it is void in trump cards and void in the suit led;

h) playing its highest non-trump card, and continuing until overtaken when it has the lead unless it only holds trump cards, wherein it plays the highest trump card it holds and continues until overtaken; and i) otherwise applying the same scoring rules for the positioned player as other players, but only to serve to keep the accuracy of the game in place without awarding the positioned player any additional finish status in the game.

9. The method of claim 8 using computer generated play, wherein each positioned player is replaced by a computer player.

10. The method of claim 9, further comprising the steps for computer generated play of:

a) replacing any player withdrawing from play prior to a finish being determined for the player with a computer generated player;

b) assigning the lowest place finish then available to the player; and c) following the play method for a positioned player for the withdrawn player.

11. The method of claim 10, further comprising the steps for computer generated cards of providing a rated gaming room and ranking the each player participating in gaming room play by:

a) initially assigning each gaming room player a rating of 2500 points;

b) each player contributing on percent (1%) of their respective rating points into a game point pool at the beginning of rating room game play;

c) deducting each player's contributed points from the player's respective rating points total;

d) awarding forty-five (45%) percent of the game point pool to the rating room game first place finisher's rating points total;

e) awarding thirty (30%) percent of the game point pool to the rating room game second place finisher's rating points total;

f) awarding fifteen (15%) percent of the game point pool from the rating room game third place finisher's rating points total;

g) awarding ten (10%) percent of the game point pool from the rating room game third place finisher's rating points total; and h) adjusting the relative rankings of rated gaming room participants as a result of the increase or decrease in the participant's rating points total.

* * * * *